United States Patent [19]

Mattiebe et al.

[11] Patent Number: 4,903,839

[45] Date of Patent: Feb. 27, 1990

[54] STACK OF BAGS EACH HAVING CONGRUENT CUTOUTS AND PERFORATED LINES

[75] Inventors: Günter Mattiebe, Maschinenbautechniker; Klaus Ullmann, Maschinenschlosser, both of Fed. Rep. of Germany

[73] Assignee: Windmoller & Holscher, Lengerich, Fed. Rep. of Germany

[21] Appl. No.: 84,950

[22] Filed: Aug. 13, 1987

[30] Foreign Application Priority Data

Aug. 19, 1986 [DE] Fed. Rep. of Germany ..... 3628031
Jan. 14, 1987 [DE] Fed. Rep. of Germany ..... 3700914

[51] Int. Cl.[4] ..... B65D 33/14

[52] U.S. Cl. ..... 206/554; 206/610; 206/611; 383/9

[58] Field of Search ..... 206/554, 806, 820, 610, 206/608, 611; 383/6, 7, 9, 10

[56] References Cited

U.S. PATENT DOCUMENTS

| | | | |
|---|---|---|---|
| 3,385,428 | 5/1968 | Kugler | 206/554 X |
| 4,305,503 | 12/1981 | Membrino . | |
| 4,493,419 | 1/1985 | Prader et al. | 206/554 |
| 4,557,385 | 12/1985 | Robinson | 206/610 X |
| 4,595,389 | 6/1986 | Lehmacher | 383/9 X |
| 4,669,251 | 6/1987 | Inagaki | 206/554 X |
| 4,759,639 | 7/1988 | deMatteis | 206/554 X |

FOREIGN PATENT DOCUMENTS

| | | | |
|---|---|---|---|
| 0136171 | 4/1985 | European Pat. Off. . | |
| 7429628 | 1/1975 | Fed. Rep. of Germany . | |
| 2408831 | 8/1975 | Fed. Rep. of Germany . | |
| 2706234 | 8/1978 | Fed. Rep. of Germany | 206/620 |
| 2803961 | 8/1978 | Fed. Rep. of Germany | 206/554 |
| 2710150 | 9/1978 | Fed. Rep. of Germany | 206/554 |
| 3445660 | 6/1986 | Fed. Rep. of Germany . | |
| 1341587 | 9/1963 | France | 206/554 |
| 187705 | 2/1937 | Switzerland | 206/554 |
| 707346 | 4/1954 | United Kingdom . | |
| 1016676 | 1/1966 | United Kingdom . | |
| 1434795 | 5/1976 | United Kingdom | 206/554 |

*Primary Examiner*—Bryon P. Gehman
*Attorney, Agent, or Firm*—Fleit, Jacobson, Cohn, Price, Holman & Stern

[57] ABSTRACT

A stack of bags is provided, which have been made from rectangular sections of synthetic thermoplastic film. The sections have been folded onto themselves about bottom fold lines and provided with side seam welds. Their open ends, the sections are also provided with centrally disposed, punched grip holes and with laterally disposed corner portions, which are defined by perforation lines and formed with aligned stacking or hanger holes. Only the rear wall of each bag is provided with perforation lines defining the two upper corner portions of the rear wall. The front wall of the bag is formed in its corner portions with apertures which are defined by cutouts, which are substantially congruent to and register with the perforation lines. A process of manufacturing such stack of bags and an apparatus for carrying out such process are also disclosed.

6 Claims, 8 Drawing Sheets

STACK OF BAGS EACH HAVING CONGRUENT CUTOUTS AND PERFORATED LINES

BACKGROUND OF THE INVENTION

1. Field of the Invention

This invention relates to a stack of bags which have been made from rectangular sections of synthetic thermoplastic film in that said sections have been folded onto themselves about bottom fold lines and provided with side seam welds and near their open ends with centrally disposed, punched grip holes and with laterally disposed corner portions, which are defined by perforation lines and formed with aligned stacking or hanger holes.

2. Description of the Prior Art

German Utility Model Specification 74 29 628 discloses a stack of bags which is of that kind and in which material is saved in that the hanger strips have been omitted, which are otherwise provided and extend over the width of the bag and are defined by perforation lines, along which the bag can be torn from the hanger strip, and provided with hanger holes.

SUMMARY OF THE INVENTION

It is an object of the invention to provide a stack of bags which is of the kind described first hereinbefore and which can more easily be handled and results in a further saving of material.

In a stack of bags which is of the kind described first hereinbefore that object is accomplished in accordance with the invention in that only the rear wall of each bag is provided with perforation lines defining the two upper corner portions of said rear wall and the front wall of the bag is formed in its corner portions with apertures which are defined by cutouts, which are substantially congruent to and register with the perforation lines. Compared with the known stack of bags the stack of bags in accordance with the invention permits a saving of 50% of the material required for the corner portions because only the rear walls of the bags are provided with corner portions for stacking and holding the bags. Besides, each bag can be torn more easily from the stack of bags because this can be accomplished by a tearing along a perforation line formed in only one wall.

The perforation lines are suitably curved, and preferably define a quadrant of a circle and have portions which are approximately at right angles to the opening-defining edges and side edges, respectively.

In a special embodiment of the invention the perforation lines include lands which differ in length and the lengths of the lands are selected in such an adaptation to the forces exerted as the bags are torn off along the perforation lines and to any curvilinear shaped of the perforation line that the tearing along the perforation line will be facilitated. That feature is particularly desirable and suitable from the aspect of a simple and economical manufacture of the bags in accordance with the invention because the bags in accordance with the invention are suitably made from a flat plastic film web having side portions which are reversely folded onto the central portion of the web in such a manner that the side edges of the web are disposed short of the center line of the web. In the processing of the plastic film web which has thus been folded said web must take up tensile stresses before the individual bags are separated by hot wire welding and the web must transmit such tensile stresses substantially without elongation. As the infolded side portions of the plastic film web are weakened by punched semicircular apertures during the manufacture of the bags, a further weakening also of the central portion should be avoided. Because the perforation lines must be formed in the central portion of the web, a weakening of said central portion cannot entirely be avoided. For this reason the lengths of the lands of the punched perforation lines are so selected in accordance with the invention that the weakening of the web will be minimized and it will still be ensured that each bag can be torn from the block of bags without destruction.

The perforation lines may be designed to have relatively long lands adjacent to the opening-defining edge and the side edge of each bag and relatively short lands in an intermediate portion. That arrangement of relatively short and relatively long lands will take the tensile and shear stresses occurring in the web into account so that the web will not be subjected to appreciable elongation in spite of the punched perforation lines.

If the tearing of the bags from the stack of bags begins adjacent to the side edges of the bags, the longer lands of the tearable perforation lines will be tolerable because that portion has been weakened anyway by the seam weld along the side edge.

The lands in the perforation lines suitably decrease in length gradually from the long lands to the short ones so that a smooth tearing of the bags from the stack will be ensured when the tearing has begun at the side edges. A fact which should be taken into account in the distribution of the shorter and longer lands resides in that the film owing to the properties of its material tends to tear along a straight line.

In a curved tearable perforation line, shorter lands, which promote the tearing, should be provided particularly in the curved portion of said line.

The opening-defining top edge of the front wall of each bag is suitably disposed short of the opening-defining edge of the rear wall so that the latter comprises an exposed strip. Such a design of stacked bags is known per se from Published German Application 24 08 831.

Within the scope of the invention the bags in the stack may be blocked to each other at the perforated corners. A blocking may also be provided at the stacking or hanger holes.

A process of manufacturing the bags in accordance with the invention is characterized in accordance with the invention in that the side portions of a plastic film web are reversely folded onto the central portion of said web so that the side edges of the web are disposed short of the center line of the web, the plastic film web which has thus been folded is fed in steps amounting to one bag width each through punching and welding stations, in which perforation lines are formed along a closed line to define portions which will constitute the corner portions of the rear walls of four subsequently formed bags, which are juxtaposed and arranged in pairs of bags which are mirror images of each other, and the stacking or hanger holes are formed in the portions thus defined, thereafter aperture-defining lines of cut are formed in those portions which will constitute the front walls of the subsequently formed bags, thereafter the punched grip holes and the transverse hot wire-welded seams which will define the side seams of the bags, or pairs of such transverse hot wire-welded seams and transverse cuts extending between said seams, are provided, and the bags which are still joined in pairs are finally severed from each other by cuts effected along the center line of the plastic film web and are stacked.

Those cutting operations by which the tearable perforation lines and the punched corner apertures are formed may be effected along circular or elliptical annular lines although those cutouts which define the punched corner apertures are interrupted by the gap which exists between the infolded side edges of the web.

It will be particularly desirable to provide tearable perforation lines which have straight end portions, which are approximately at right angles to the side edges and to the opening-defining edges of the bag. For this reason it is contemplated within the scope of the invention to provide the annular cutouts and the annular tearable perforation lines in the form of a quadrangle having rounded corners or in the form of a polygon in such a manner that the perforation lines join the side edges and the opening-defining edges of the bag approximately at right angles thereto.

Apparatuses for carrying out the process in accordance with the invention will be defined in claims 10 to 12.

DETAILED DESCRIPTION OF THE PREFERRED EMBODIMENTS

Figure 1:
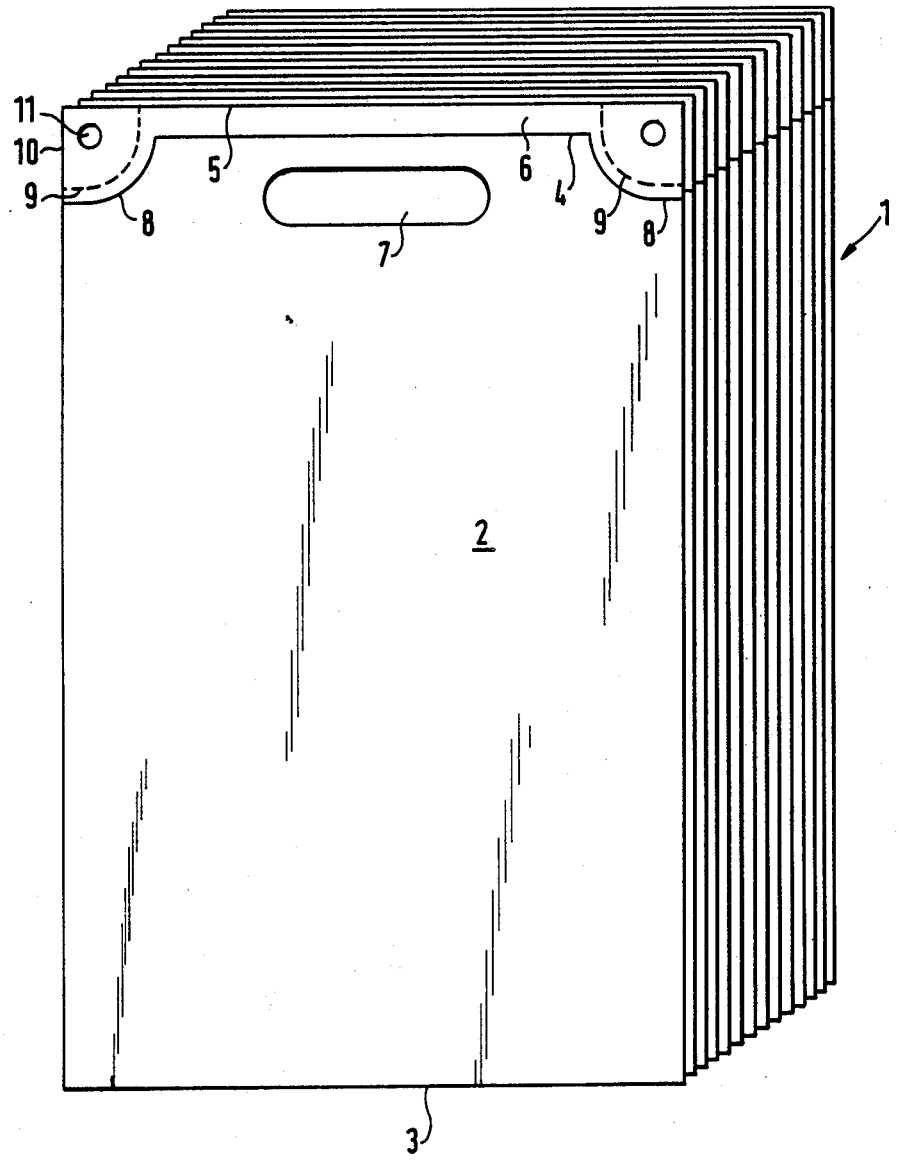
FIG. 1 is a perspective view showing a stack of bags.

Illustrative embodiments of the invention will now be explained more in detail with reference to the drawing.

The stack 1 consists of stacked bags 2 which have been formed from rectangular sections of plastic film in that the film has been folded on itself about the bottom fold line 3. The opening-defining edges 4 of the front walls of the bags are disposed short of the opening-defining edges 5 of the rear walls of the bags 2 so that the rear wall of each bag has an exposed strip 6 at the open end of each bag 2 opposite bottom fold line 3. Adjacent to the open end of each bag 2, it is provided in the usual manner with punched grip holes 7. In those corner portions of each bag 2 which are adjacent to its open end, the front wall is formed with approximately quadrant-shaped cutout portions, which are defined by cutouts 8. The rear wall of each bag is formed with approximately quadrant-shaped perforation lines 9, which are substantially congruent to and register with said cutouts. The corner portions 10 of the rear wall are defined by the perforation lines 9 and are formed with punched holes 11, which are used to stack and/or suspend the stacked bags 2.

Figure 2:
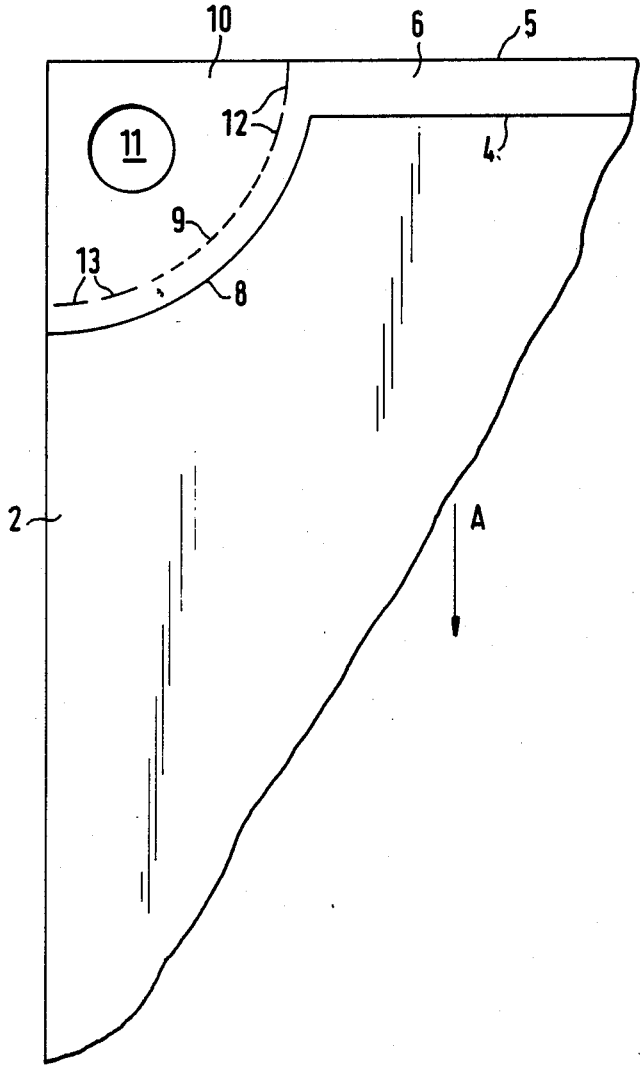
FIG. 2 shows a corner portion of a bag.
Figure 8:
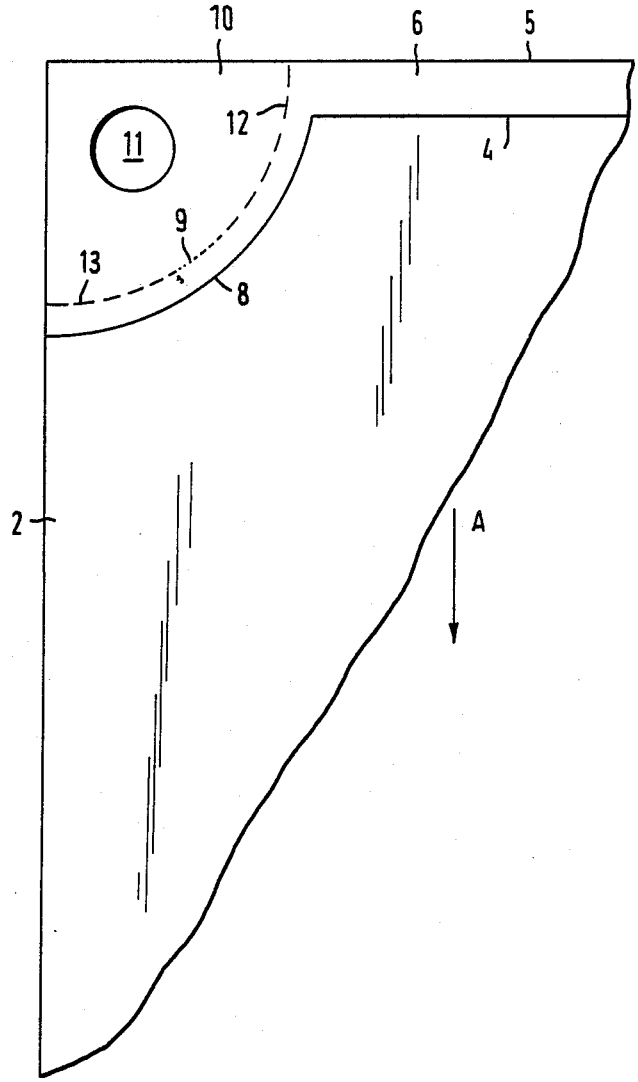
FIG. 8 is a view substantially identical to FIG. 2, but showing the perforation lines with gradually decreasing lengths.

It is apparent from FIGS. 2 and 8 that the perforation lines 9 join the opening-defining top edges and the side edges of the bags approximately at right angles thereto. Adjacent to the opening-defining edges 5 and adjacent to the side edges the perforation lines 9 have relatively long lands 12, 13, which are represented by solid lines. Between the portions formed with the relatively long lands 12, 13, each perforation line has relatively short lands in an intermediate portion.

The cutouts 8 and the perforation lines 9 defining each corner portion of a bag are, i.e. parallel approximately congruent radially to and offset slightly so as to register with each other; they are shown in a relatively substantially offset arrangement in the drawing for the sake of clearness.

Each bag 2 is provided with seam welds along its side edges in the usual manner.

When it is desired to tear a bag 2 from the stack 1, that bag is grasped and is pulled from the stack 1 in the direction indicated by the arrow A.

Figure 3:
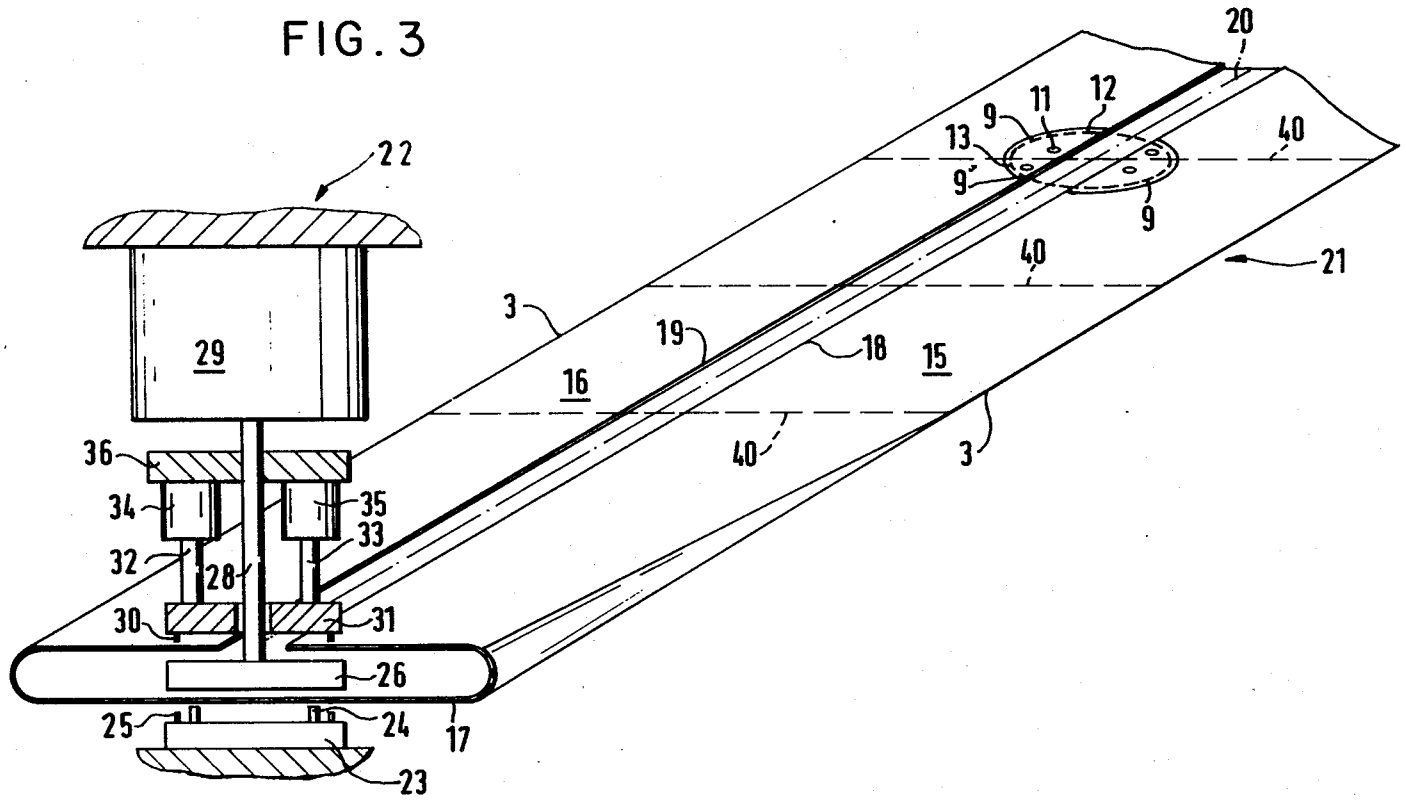
FIG. 3 is a diagrammatic sectional view showing the means for punching the corner portions of the bags.

The manufacture of the bags will now briefly be explained with reference to FIG. 3.

In the manufacture of the bags, the side portions 15, 16 of a plastic film web are reversely folded about fold lines 3 onto the central portion 17 of the web in such a manner that the infolded side edges 18, 19 are disposed short of the center line 20 of the web. The double-folded web 21 which has thus been prepared is then moved through the punching station 22 in steps corresponding to the width of one bag each, as is known per se. In said punching station the lines defining corner portions of the subsequently formed bags are punched.

The punching means comprise a stationary cutter plate 23, which is provided with four punching cutters 24, which have an annular cutting edge each and serve to punch the stacking or hanger holes 11, and with perforating cutters 25, which surround respective punching cutters 24 and serve to punch the perforation lines 9. When it is desired to punch the stacking or hanger holes 11 and the annular perforation lines 9 surrounding said holes, an abutment is lowered onto the adjacent central portion 17 of the plastic film web. The abutment plate 26 is operable by the fluid-operable cylinder 29, which is fixed to the machine frame and has a piston rod 28, to which the abutment plate 26 is secured. The top surface of the abutment plate 26 constitutes an abutment for cutters 30, which are also approximately circular and are carried by a cutter plate 31, which is operated by means of fluid-operable cylinders 34, 35, which are secured to a mounting plate 36 and have piston rods 32, 33, to which the cutter plate 31 is secured. The mounting plate 36 is secured to the piston rod 28 of the cylinder 29.

The gap left between the infolded side edges 18, 19 of the film web 21 is so wide that the piston rod 28 can extend through that gap so that the abutment plate 26 can extend between the central portion 17 and the infolded side portions 15, 16 of the film web 21.

The cylinders 29, 34, 35 are provided with supply hoses, which are not shown and serve to supply a pressure fluid, such as oil or compressed air, to the cylinders.

The annular cutter 30 provided on the underside of the cutter plate 31 serve to punch the corner apertures, or cutouts 8 of the infolded web portions in the regions which will constitute the corner portions of the bags to be formed.

The width of the cutters 25 for cutting the perforation lines 9 is so selected that each perforation line has long lands 12 extending transversely to the longitudinal direction of the web and short lands 13 extending in the longitudinal direction of the web.

When the web 21 has been punched in those regions which will form the corner portions of the bags, the several bags are separated by a formation of hot wire-welded transverse seams along the transverse lines 40 indicated by dotted lines. The double bags thus formed, which are still joined along the center line of the web, are subsequently separated by longitudinal cuts.

The punched grip holes 7 may be punched as the hot wire-welded transverse seams are formed or in a separate operation.

Figure 5:
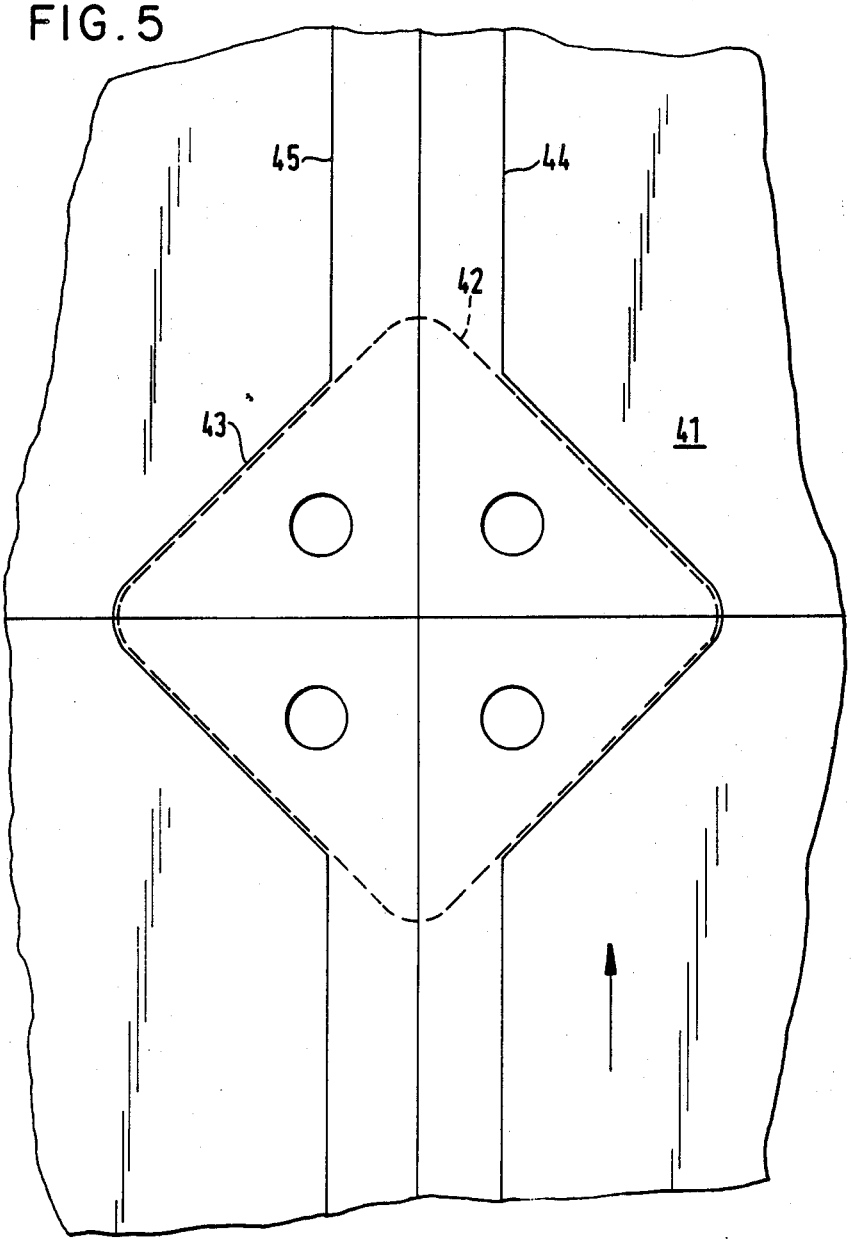
FIG. 5 is a top plan view showing a plastic film web provided with a quadrangular cutouts and a quadrangular perforation line.

FIG. 5 is a top plan view showing a plastic film web 41, which in the bags are still joined and in which the portions which will constitute the corner portions of said bags are defined by a quadrangular annular perforation line 42 and an aperture-defining, annular cutout 43, which is approximately congruent to and registers with the perforation line 42 and is interrupted adjacent to the longitudinal center line 20 of the film web by the gap that has been left between the inner edges 44, 45 of the infolded web portions.

The square perforation line and the square cutout have rounded corners and have such a configuration that the opening-defining edges and side edges of the subsequently formed bags will be joined by said perforation lines and cutouts at right angles to said edges.

The perforation lines 42 have relatively long lands adjacent to the side edges and opening-defining edges of the subsequently formed bags and have shorter lands in an intermediate portion.

Figure 4:
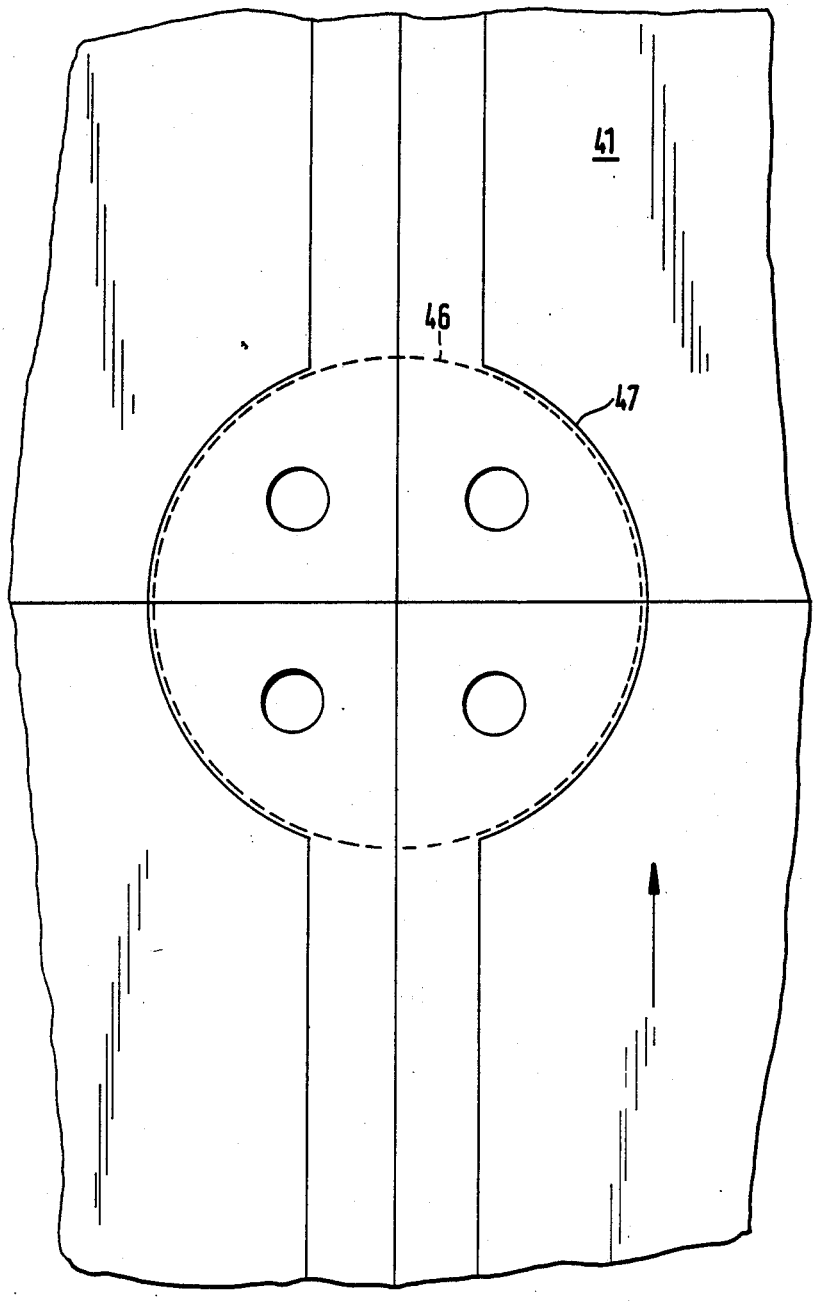
FIG. 4 is a top plan view showing a plastic film web provided with a circular cutouts and a circular perforation line.

FIG. 4 is a top plan view showing a plastic film web in which the bags are still joined and in the portions which will constitute the corner portion of said bags are defined by a circular perforation line 46 and by an aperture-defining cutout 47, which is also circular and is approximately congruent to and registers with the perforation line 46. In the illustrated angular regions which include the opening-defining edges and side edges of the subsequently formed bags the perforation lines have lands which have a length of 0.5 mm each. Between said portions the lands of the perforation lines have a length of only 0.3 mm each.

Figure 6:
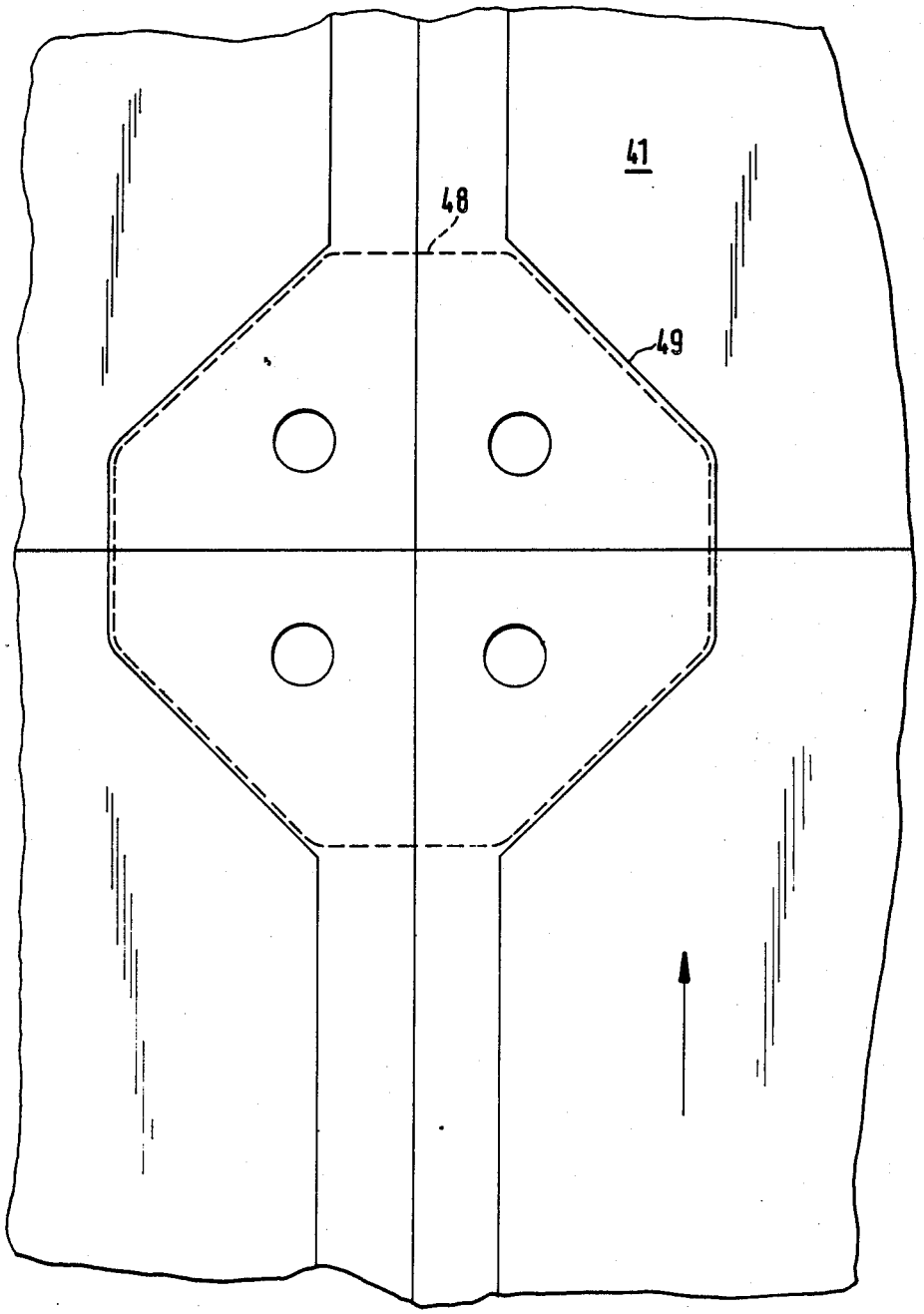
FIG. 6 is a top plan view showing a plastic film when provided with an octagonal cutout and an octagonal perforation line.

FIG. 6 is a top plan view showing a plastic film web in which the subsequently formed bags are still joined and in which the regions which will constitute the corner portions of said bags are defined by an octagonal perforation line 48 and by a cutout 49, which is approximately congruent to and registers with the perforation line 48. Owing to the octagonal configuration of the perforation lines it is ensured that the opening-defining edges and side edges of each of the subsequently formed bags will be joined by the perforation line at right angles thereto. Those legs of the punched perforation lines which are approximately at right angles to the opening-defining edges and side edges of the subsequently formed bags are formed with relatively long lands.

Figure 7:
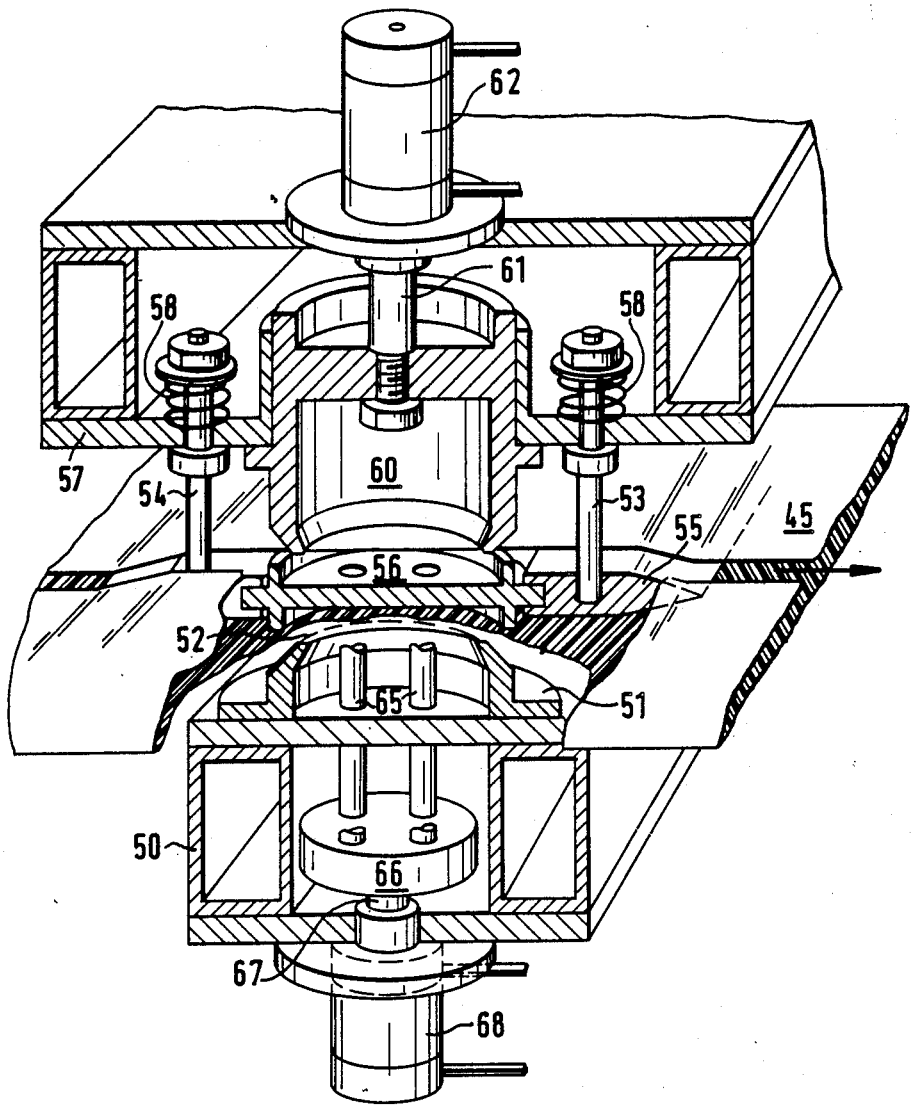
FIG. 7 is a sectional view showing a second embodiment of means for punching corner portions of the bags.

A second embodiment of punching means for defining the regions which will constitute the corner portions of the subsequently formed bags will now be explained more in detail with reference to FIG. 7. A cutter plate 51 provided with a circular perforating cutter 52 is secured to a beam 50 of the frame. Guide pins 53, 54 are provided above that perforating cutter 52 and a holder 55 for an abutment plate 56, which overlies the perforating cutter 52, is secured to said guide pins 53, 54, which are longitudinally slidably guided in bores formed in a guide plate 57 of the machine frame. Compression springs 58 urge the abutment plate 56 to its uppermost position.

A circular punching cutter 60 is disposed above the abutment plate 56 and is secured to the piston rod 61 of the pneumatic cylinder 62.

The guide pins 53, 54 extend into the gap which has been left between the inner edges of the infolded side portions of the film web 45 so that the abutment plate 56 extends between the central portion and the infolded side portions of the film web 45.

When the piston rod 61 is operated to lower the circular punching cutter 60, the latter will strike against the top face of the abutment plate 56 and the latter will be stabilized and forced down by the punching cutter 60 as the latter is lowered further. The abutment plate 56 finally engages the serrations of the circular lower perforating cutter 52. When a suitable pressure is then applied by the pneumatic cylinder 62, the aperture-defining cutouts and the annular perforation lines are then punched.

As the upper punching cutter 60 is subsequently raised, the compression springs lift the abutment plate 56 from the lower perforating cutter 52 so that the web 45 can be advanced by another step.

The hanger holes are formed by punching cutters 65, which are carried by a plate 66, which is secured to the piston rod 67 of a pneumatic cylinder 68. The punching cutters 65 extend through the cutter plate 51 and through the abutment plate 56 in suitable bores, which serve also as guides. During the punching cuts and the formation of the annular perforation lines the punching cutters 65 are extended and subsequently retracted to punch the hanger holes.

We claim:

1. A stack of bags comprising:

rectangular sections of synthetic thermoplastic film joined together at bottom fold lines and forming front and rear walls of each bag, seam welds at each lateral side of each bag, an open end provided in each bag opposite its bottom fold line, perforation lines, provided only in said rear wall of each bag, defining two upper, laterally disposed corner portions of said rear wall of each bag of approximately single quadrant shape, cutouts provided in said front wall only of each bag defining an approximately single quadrant-shaped cutout portion in each of two upper, laterally disposed corner portions of said front wall, said cutouts being substantially congruent, parallel to and radially offset corresponding to said perforation lines of each bag, each bag further including hanger holes in said upper, laterally disposed corner portions thereof aligned with hanger holes in the other bags in said stack of bags, and each bag including grip holes located adjacent its open end and centrally between said two upper, laterally disposed corner portions of said rear wall and said cutouts of said front wall.

2. A stack of bags according to claim 1, wherein the perforation lines includes lands which differ in length and the lengths of the lands are selected considering the forces exerted as the bags are torn off along the perforation lines and any curvilinear shape of the perforation line so that tearing of the bags along the perforation lines will be facilitated.

3. A stack of bags according to claim 1, wherein an open-end-defining top edge is provided on the front wall of each bag and is disposed short of an open-end-defining edge provided on the rear wall so that the rear wall comprises an exposed strip.

4. A stack of bags according to claim 1, wherein the bags are blocked to each other in the stack adjacent to the corner portions defined by the perforation lines.

5. A stack of bags comprising:

rectangular sections of synthetic thermoplastic film joined together at bottom fold lines and forming front and rear walls of each bag, seam welds at each lateral side of each bag, an open end provided in each bag opposite its bottom fold line, perforation lines, provided in said rear wall of each bag, defining two upper, laterally disposed corner portions of said rear wall of each bag of approximately single quadrant shape, cutouts provided in said front wall only of each bag defining an approximately single quadrant-shaped cutout portion in each of two upper, laterally disposed corner portions of said front wall, said cutouts being substantially congruent, parallel to and radially offset corresponding to said perforation lines of each bag, each bag further including hanger holes in said upper, laterally disposed corner portions thereof aligned with hanger holes in the other bags in said stack of bags, said perforation lines of each bag having relatively long lands adjacent to an opening-defining edge of said rear wall and adjacent each said lateral side of each bag and relatively short lands in an intermediate portion located between said relatively long lands, and each bag including grip holes located adjacent its open end and centrally between said two upper, laterally disposed corner portions of said rear wall and said cutouts of said front wall.

6. A stack of bags according to claim 5, wherein the lands included in the perforation lines decrease in length gradually from the long lands to the short lands.

* * * * *